United States Patent [19]

Lidholm

[11] 4,209,880

[45] Jul. 1, 1980

[54] COFFIN

[76] Inventor: Sven-Olof Lidholm, Rosbacken 41, S-162 40 Vällingby, Sweden

[21] Appl. No.: 949

[22] Filed: Jan. 4, 1979

[30] Foreign Application Priority Data

Jan. 19, 1978 [SE] Sweden ..... 7800695

[51] Int. Cl.[2] ..... A61G 17/00

[52] U.S. Cl. ..... 27/2; 27/4

[58] Field of Search ..... 27/2, 4, 16, 17, 3; 229/41 R, 41 B, 34 R, 34 B, 43, 31 R

[56] References Cited

U.S. PATENT DOCUMENTS

| | | | |
|---|---|---|---|
| 3,574,906 | 4/1971 | Rittenhouse | 27/4 |
| 4,156,956 | 6/1979 | Partridge et al. | 27/4 |

FOREIGN PATENT DOCUMENTS

| | | | |
|---|---|---|---|
| 1947995 | 4/1971 | Fed. Rep. of Germany | 27/4 |
| 2013739 | 10/1971 | Fed. Rep. of Germany | 27/4 |

*Primary Examiner*—John D. Yasko

*Attorney, Agent, or Firm*—Sughrue, Rothwell, Mion, Zinn and Macpeak

[57] ABSTRACT

A coffin comprising substantially pairs of mutually opposing side walls, a bottom and a lid. At least the side walls are made of a strong corrugated paper material having inwardly turned bottom flaps. The bottom flaps are fixed between an outer bottom plate and an inner bottom plate whose edges abut the inner surfaces of the side walls. Attachment means are provided for mounting foot supports on the under surface of the bottom plate, said attachment means extending through at least the outer bottom plate and the bottom flaps.

7 Claims, 7 Drawing Figures

COFFIN

Figure 1:
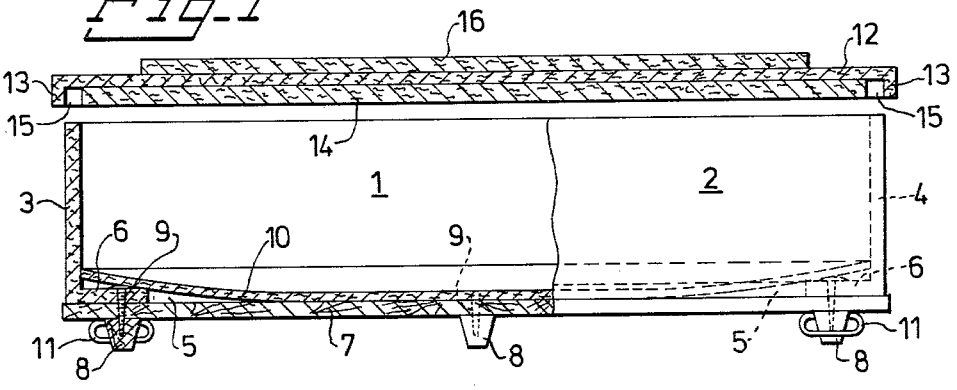

The present invention relates to a coffin comprising substantially pairs of mutually opposing side walls, a bottom and a lid.

There has long been the need for a simpler form of coffin, partly for economic reasons and partly because it is desirable that a coffin is able to decay or to burn without creating, inter alia, environmental problems. Thus, the adornment of coffins with plastics or metal ornaments has been refrained from, and the over-dimensioning of the walls, bottom and lid of said coffin has been avoided.

In addition to modifications in respect of the aforementioned economic and environmental reasons, there is still room for further simplification with regard to new coffins, for transport and handling reasons. The fact that accidents and natural catastrophies resulting in an ever increasing number of victims occur, and are liable to occur more often in the future, cannot be ignored. The transport of coffins to and the handling of the coffins at the place where the accident or catastrophy occurred which is often located in a densely populated area or a highly trafficated area, for example a large airport, represents a sensitive problem which is difficult to overcome and which could be greatly alleviated if coffins were constructed in a manner such that they could be stored and transported in a collapsed or unerected state and were made of an exceptionally light material and could be readily formed into coffins of conventional but plain and simple design and have those characteristics normally required of coffins. The object of the present invention is to provide a novel type of coffin having the aforementioned characteristics.

This has been achieved in accordance with the invention by constructing a coffin of the type mentioned in the introduction of which at least the side walls comrpise a robust corrugated paper material having inwardly folding bottom flaps which are fixed between an outer bottom plate and an inner bottom plate whose edges abut the inner surfaces of the side walls; in which there are arranged attachment means of a type which can readily be applied for attaching foot supports to the undersurface of the outer bottom plate, said attachment means being arranged to extend through at least the outer bottom plate and the bottom flap. Despite the simple and light material from which such a coffin is made, the coffin exhitits unexpectedly good mechanical strength properties, owing to the fact that (a) the walls of corrguated paper material fixed to an outer bottom plate in the manner beforementioned are highly resistant to external forces, and (b) the direct connection between the support, the outer bottom plate and the bottom flaps of the side walls, and also the inner bottom plate provides a coherent, continuous unit which is able to withstand relatively heavy treatment to no detriment. The corrugated paper side walls are limited in the normal manner in the longitudinal direction thereof by folding lines at all corners with the exception of one, where a joint is arranged in a suitable manner. In the unassembled or non-erected condition of the coffin, the coherent side walls can thus be folded flat and the greater part of the side walls placed between and protected by the bottom plates and the lid during transport of the coffin. When assembling the coffin, the walls can be readily extruded and erected quite quickly, and the bottom flaps folded in, which flaps are then drawn fast against the outer bottom plate when mounting the foot supports.

Improved retention of the bottom flaps and increased rigidity of the bottom of the coffin can also be obtained when the inner bottom plate according to one embodiment of the invention is also drawn fast by means of the fastening means for the foot supports.

According to a further embodiment of the invention, the width of the bottom flaps is conveniently one quarter the width of the inner bottom plate, whereby the edges of said bottom plate rest on a support surface which is higher than its middle part, thereby eliminating the risk of any liquid which may form within the coffin from leaking out.

When the outer bottom plate is also made of a corrugated paper material, it is particularly convenient in accordance with a further embodiment of the invention for the foot supports to comprise two longitudinally extending and/or transversal strips of wood, which provide a better support than separate feet of a conventional type. In condition, the bottom flaps can be further secured, for example by means of stapling devices, through the outer bottom plate in the strips of wood, also at location between the first mentioned securing means, which must be of a stronger and more robust type, for example screws.

In accordance with another embodiment, the outer bottom plate comprises a material which is stronger than a corrugated paper material, namely plywood, foot supports in the form of four or, preferably, six separate feet being the most convenient to use.

To protect the corrugated paper material against wet conditions and damp the various elements of the coffin are suitably coated in a known manner with a protective layer, preferably wax.

Figure 2:
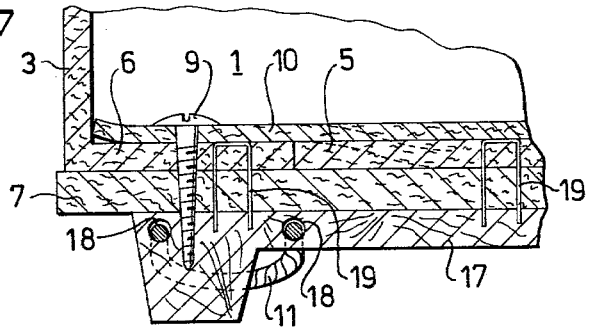
Figure 3:
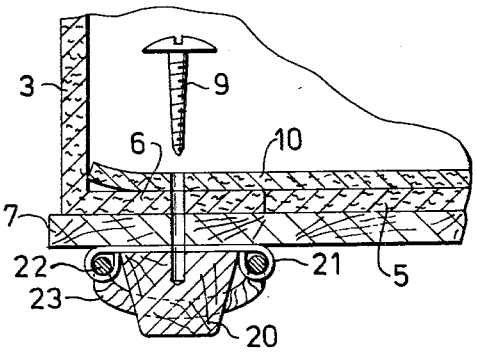
Figure 4:
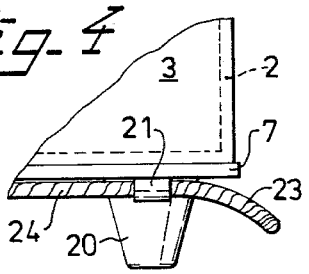
Figure 5:
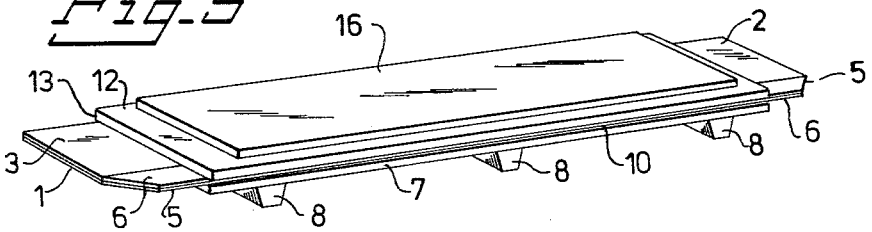
Figure 6:
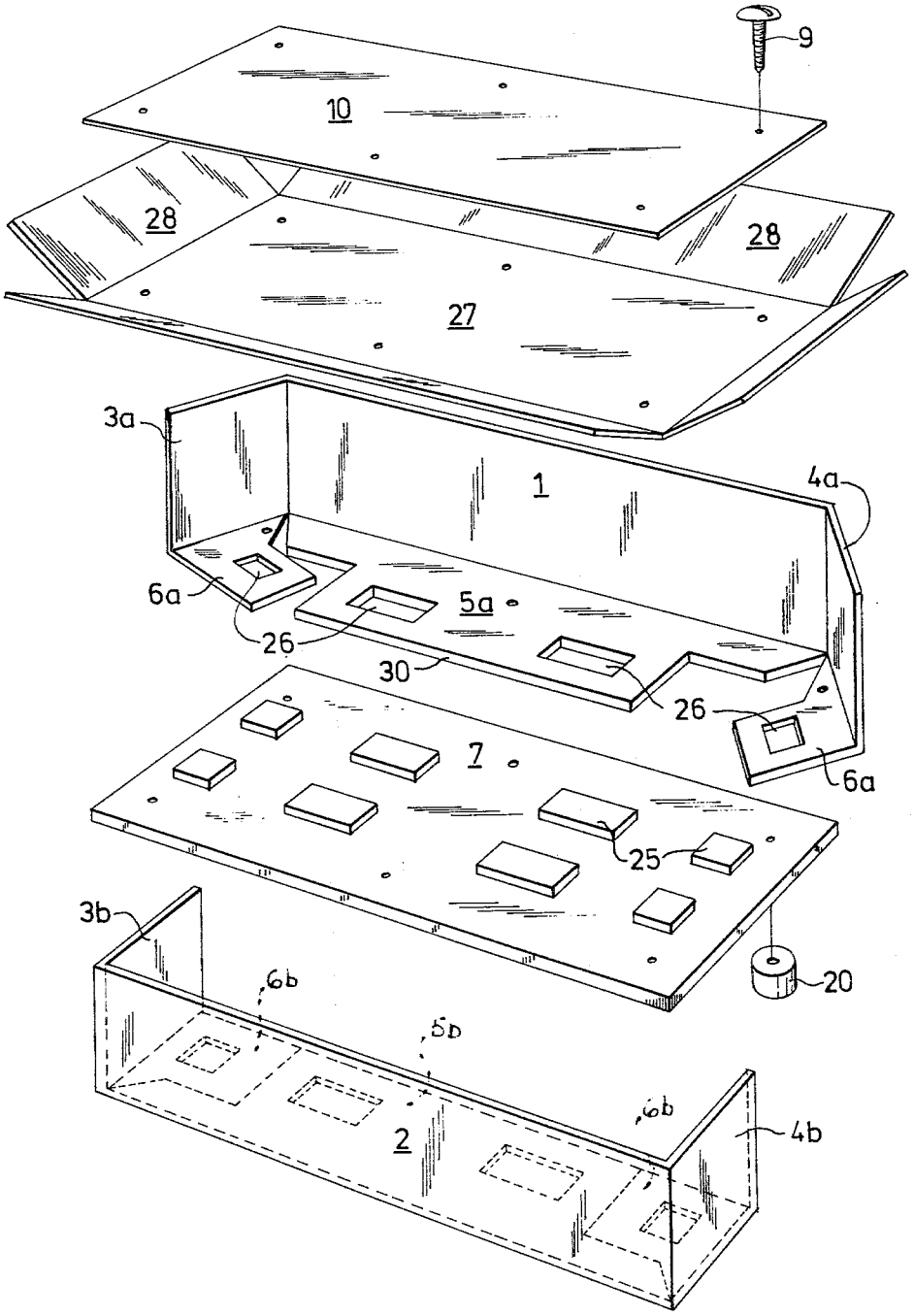
Figure 7:
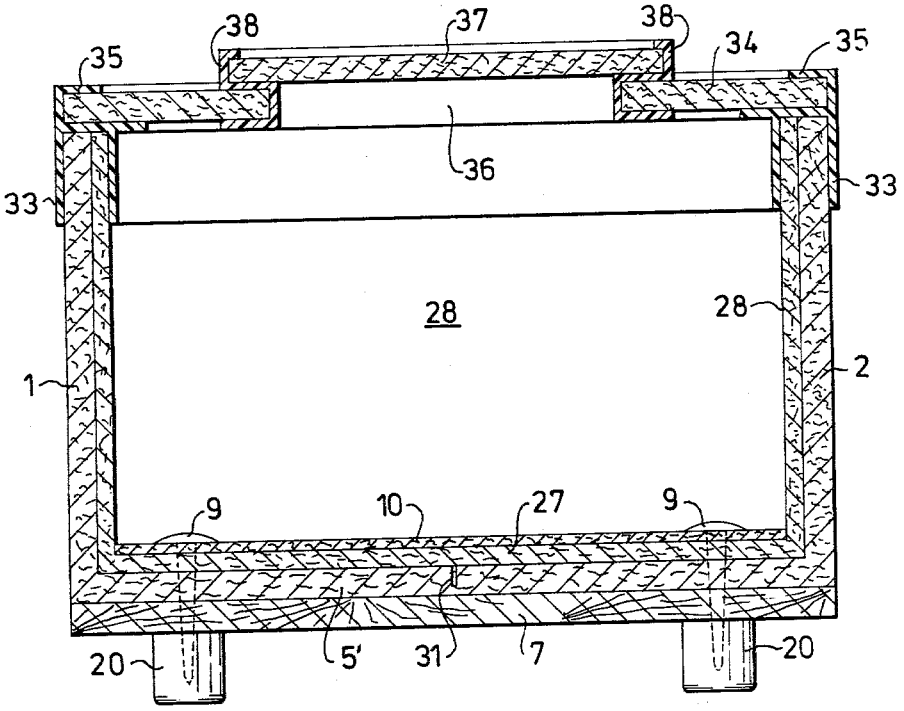

So that the invention will be more readily understood and further features thereof made apparent, exemplary embodiments of coffins made in accordance with the invention will now be described with reference to the accompanying schematic drawings, in which:

FIG. 1 is a side view, partly in section, of a coffin according to a first embodiment of the invention, FIG. 2 is a longitudinal sectional view in larger scale of a part of a coffin according to a further embodiment of the invention, FIG. 3 is a side view of a detail in section showing a securing means for a separate foot support having a holder for a carrying handle, FIG. 4 is an end view of the detail illustrated in FIG. 3, FIG. 5 is a perspective view of the coffin in its collapsed state, FIG. 6 is a perspective view of the various elements required for erecting and assembling a further embodiment, of a coffin according to the invention, and FIG. 7 is a cross sectional view of a preferred embodiment similar to that illustrated in FIG. 6 but with the longitudinally extending bottom flaps joined together.

The coffin illustrated in FIG. 1 has two long sides, 1,2 and two short sides 3,4, which are made of a strong corrugated paper material and which are connected together at three corners by fold lines and at the remaining corner by means of a joint. The sides are provided at the bottom thereof with inwardly folded, longitudinally extending bottom flaps 5 and transversal bottom flaps 6, which abut the upper surface of an outer bottom plate 7 made of plywood. Three transversally extending foot-supports 8 are secured to the bottom plate 7 by means of screws 9, which extend through holes in the bottom plate 7 and the bottom flaps 6 and 5. An inner bottom plate 10 is pressed down on to the bottom flaps 5,6, which have a width corresponding to approximately one quarter of the width of the bottom plate 7, and onto the bottom plate 7 with the edges abutting the inner surfaces of the side walls, 1–4. The inner bottom plate may comprise a relatively thin sheet of corrugated paper material or some other suitable material. A carrying handle 11 is pivotally arranged at the ends of the two outermost foot-supports 8.

The lid of the coffin comprises a thick sheet 12 of corrugated paper material with downwardly folded edges 13. A further sheet 14 of corrugated paper material is glued to the undersurface of the sheet 12 in a manner such as to form a groove or channel 15 between the side edges of the sheet 14 and the inner surfaces of the downwardly folded edges 13, the width of said groove being equal to the thickness of the side walls 1–4, whereby the lid can be pressed firmly on to the upper edge portions of the walls 1–4. In order to strengthen the coffin and to impart thereto an aesthetic appearance, a plate 16 may be placed on top of the sheet 12.

FIG. 2 illustrates a variant in which the outer bottom plate 7 is made of a relatively thick sheet of corrugated paper material. In order to strengthen the outer bottom plate, the inner bottom plate 10 is manufactured of a relatively thick corrugated paper material and the attachment screws 9 for the foot support are arranged to extend through holes in the inner bottom plate 10.

In order to further strengthen the bottom of the coffin, the foot-supports have the form of two longitudinally extending wooden supports 17. The carrying handle 11 is pivotally connected at the ends of a respective support 17, said handle having the form, for example, of a rope loop passing through two holes 18 in the respective ends of the supports 17. To facilitate assembly of the side walls 1–4 and to improve the attachment of the bottom flaps 5,6 of said walls to the corrugated sheet 7, the flaps may be fastened with staples from a stapling device, prior to securing the inner bottom plate, staples 19 being passed through the flaps and the bottom plate 7 down in the foot-support 17.

The various elements of the coffins can be factory produced with a high surface finish, by applying to all surfaces and edges a covering layer of paper having a veneer or plywood-like print, or painted white. The covering layer may also comprise a thin veneer glued to the respective surface. When distributed from the factory, the coffin may be collapsed to form a thin package, as illustrated in FIG. 5.

As before mentioned, the outer and inner surfaces of the coffin are treated, suitably, with wax, in a manner effective to protect said surfaces against moisture. The annular groove or channel 15 in the lid of the coffin should also be coated with wax, thereby rendering the coffin completely air-tight.

When the coffin is in use, liquid is liable to collect on the inner bottom plate, which must thus be provided with a water-tight surface and be in sealing contact with the inner surfaces of the side walls. As a result of the limiting width of the bottom flaps 5,6, the centre parts of the plate 10 will sink down against the upper surface of the outer bottom plate 7 and, as a result hereof, will be gently cup-shaped, which reduces the risk of leakage around the edges. Particularly when the outer bottom plate 7 is made of plywood or a like material, it is also possible to arrange foot-supports in the form of, e.g., four or six separate feet 20, as illustrated in FIG. 3. Conveniently, there may be arranged between the feet 20 located at the end of the coffin and the undersurface of the bottom plate 7 a holder 21 of wood, metal or like material, having two holes 22 for attaching the carrier handles 23. The handles may comprise rope loops which are connected in pairs by means of securing means 24 mounted on the undersurface of the bottom plate 7, as illustrated in FIG. 4.

FIG. 6 illustrates an embodiment which differs from the aforedescribed and illustrated embodiment by the fact that the sides 1–4 of the coffin with associated bottom flaps 5,6 are divided into two separate parts, by dividing the short sides 3,4 with associated flaps 6 along the centre into parts *3a,3b* and *4a,4b* and *6a,6b* respectively; and providing the outer bottom plate 7 with a plurality of upstanding shoulders 25 of the same material and thickness as the bottom flaps *5a,5b,6a,6b* which are provided with corresponding recesses 26 in a manner such as to enable the bottom flaps to be pressed fast onto the bottom plate 7 when assembling the coffin. Further, an additional inner bottom plate 17 having upstanding side flaps 28 is placed on top of the bottom flaps *5a,5b,6a,6b,* whereafter the aforementioned inner bottom plate 10 is intended to be placed on top of the additional bottom plate 27. The two shorter side flaps 28 may be provided with strips of self-adhesive tape (not shown) arranged along the vertical centre lines, by means of which tape the joint edges of the short sides 3,4 can be pressed fixedly against the strips subsequent to removing the protective strip therefrom.

Optionally a strengthening rim (not shown) of U-shaped cross-section can be clamped around the upper edge of the assembled coffin and optionally fixed by self-adhesive tape placed, for example, on the upper edges of the coffin.

If desired, the inner bottom plate 10 may be dispensed with and only plate 27 retained. The bottom flaps *5a,5b* have a width equal to half the width of the coffin, and hence the edge of the bottom flap *5a* referenced 30 extends along the centre line of the bottom plate 7.

The preferred embodiment illustrated in FIG. 7 differs from the embodiment of FIG. 6 in that the bottom flaps *5a* and *5b* are joined to each other along the edge 30 (FIG. 6). The bottom flaps *5a,5b* are suitably formed as a single-piece structure with the bottom part 5', optionally with a folding line 31 arranged along the centre line (corresponding to the edge line 30) such that the bottom part 5' can be folded on the centre during transport of a non-assembled coffin. The locking shoulders 25 illustrated in FIG. 6 with associated recesses 26 are not required in the embodiment illustrated in FIG. 7, since the bottom part 5' is made in one piece and the bottom flaps *6a,6b* are firmly clamped and fixed between the bottom plate 7 and the bottom part 27.

Mounted around the upper edges of the coffin as a substantially U-shaped profile 33 having thin walls and made of a semi-hard plastics material, on which profile a flat lid 34 rests, said lid being guided and locked firmly by an upwardly extending angular strip 35, which can be partly folded up when the lid 34 is placed in position.

An opening 36 may be arranged in the centre part of the lid, said opening being covered by a cover 37 secured by means of a substantially, in cross-section, S-shaped plastics profile 38 which extends around the circumference of the opening 36. Thus, in this manner there can be provided a radily openable opening, the provision of such an opening being usual in certain countries, despite the fact that both the lid 34 and the cover 37 are made of a corrugated paper material.

The invention is not restricted to the described and illustrated embodiment, but can be modified within the scope of the following claims.

The invention also embraces the use of a material having properties which are equivalent to those of a sheet of corrugated paper material, for example a material having a core of porous paper pulp instead of corrugated paper.

I claim:

1. A coffin comprising substantially pairs of mutually opposing side walls, a bottom and a lid, characterised in that at least the side walls (1–4) comprise a robust corrugated paper material having inwardly folded bottom flaps (5,6,5') which are fixed between an outer bottom plate (7) and an inner bottom plate (10,27), the edges of which abut the inner surfaces of the side walls (1–4), attachment means (9) of a type which can be readily applied for securing foot supports (8,17,20) to the undersurface of the outer bottom plate (7) being arranged to extend through at least the outer bottom plate (7) and the bottom flaps (5,6,5').

2. A coffin according to claim 1, characterised in that the attachment means (9) also extend through the inner bottom plate (10,27).

3. A coffin according to claim 1 or 2, characterised in that the bottom flaps (5,6) of the side walls have a width which is equal to one quarter of the width of the inner bottom plate (10), whereby the edges of said bottom plate rest on a higher support surface than its centre part.

4. A coffin according to claims 1 or 2, characterised in that the foot-supports comprise two longitudinal exending wooden strips (17).

5. A coffin according to claim 4, charaterised in that the outer bottom plate (7) also comprises a sheet of corrugated paper material.

6. A coffin according to claims 1 or 2, characterised in that the outer bottom plate (7) is made of plywood and the foot supports comprise at least four separate feet (20).

7. A coffin according to claims 1 or 2, characterised in that the foot-supports comprise at least two transversely extending wooden strips (8).

* * * * *